US010978838B2

(12) United States Patent
Stikeleather et al.

(10) Patent No.: US 10,978,838 B2
(45) Date of Patent: Apr. 13, 2021

(54) MULTI-STAGE TERMINATION OF A CABLE TO AN RJ-45 OUTLET

(71) Applicant: Optical Cable Corporation, Roanoke, VA (US)

(72) Inventors: Derrick F. Stikeleather, Black Mountain, NC (US); Sumio Seo, Wallingford, VT (US)

(73) Assignee: Optical Cable Corporation, Roanoke, VA (US)

( * ) Notice: Subject to any disclaimer, the term of this patent is extended or adjusted under 35 U.S.C. 154(b) by 0 days.

(21) Appl. No.: 16/373,310

(22) Filed: Apr. 2, 2019

(65) Prior Publication Data

US 2019/0305496 A1 Oct. 3, 2019

Related U.S. Application Data

(60) Provisional application No. 62/651,460, filed on Apr. 2, 2018.

(51) Int. Cl.

| | |
|---|---|
| ***H01R 24/64*** | (2011.01) |
| ***H01R 13/66*** | (2006.01) |
| ***H01R 13/502*** | (2006.01) |
| ***H01R 4/2433*** | (2018.01) |

(52) U.S. Cl.

CPC ..... *H01R 24/64* (2013.01); *H01R 4/2433* (2013.01); *H01R 13/502* (2013.01); *H01R 13/6658* (2013.01)

(58) Field of Classification Search

CPC .... H01R 24/64; H01R 4/2433; H01R 13/502; H01R 13/6658; H01R 2107/00

See application file for complete search history.

(56) References Cited

U.S. PATENT DOCUMENTS

| | | | | |
|---|---|---|---|---|
| 5,358,424 | A * | 10/1994 | Bowen | H01R 4/2433 29/857 |
| 5,727,962 | A * | 3/1998 | Caveney | H01R 13/6463 439/344 |
| 6,793,515 | B1 * | 9/2004 | Gwiazdowski | H01R 13/6463 439/344 |
| 10,116,082 | B2 * | 10/2018 | Sullivan | H01R 13/46 |
| 2005/0079755 | A1 * | 4/2005 | Saka | H01R 31/085 439/404 |

(Continued)

*Primary Examiner* — Truc T Nguyen

(74) *Attorney, Agent, or Firm* — William G. Heedy; The Van Winkle Law Firm

(57) ABSTRACT

A termination mechanism for reducing the force required by a user to terminate a plurality of wires by staggering the moment in which each wire of the plurality of wires encounters a respective insulation displacement contact (IDC) when connecting twisted-pair cables to an RJ45 connector includes a wire manager including a first and second groupings of wire manager slots; the first and second groupings of wire manager slots being at different depths relative to the respective IDCs; and wherein selective force applied by the user to the wire manager in the direction of the PCB causes a first stage of termination wherein each IDC of a first plurality of the IDCs is electrically connected with a corresponding wire of the plurality of wires in the first grouping of wire manager slots and continued selective force causes a second stage of termination in the second grouping of wire manager slots.

8 Claims, 4 Drawing Sheets

(56) References Cited

U.S. PATENT DOCUMENTS

| | | | | |
|---|---|---|---|---|
| 2010/0227496 | A1* | 9/2010 | Sticker | H01R 24/64 439/417 |
| 2011/0039422 | A1* | 2/2011 | Muir | H01R 9/032 439/65 |
| 2012/0270433 | A1* | 10/2012 | Myer | H01R 4/2454 439/404 |
| 2013/0090005 | A1* | 4/2013 | Nesme | H04Q 1/142 439/391 |
| 2015/0236432 | A1* | 8/2015 | Lin | H01R 13/5841 439/367 |

* cited by examiner

MULTI-STAGE TERMINATION OF A CABLE TO AN RJ-45 OUTLET

RELATED APPLICATION

This application claims priority to and incorporates entirely by reference U.S. Provisional Patent Application Ser. No. 62/651,460 filed on Apr. 2, 2018.

FIELD OF INVENTION

This invention relates to connecting twisted-pair cables to an RJ45 style jack or plug and, more particularly, multi-stage termination of a cable to an RJ-45 outlet.

BACKGROUND OF THE INVENTION

There are various methods for connecting twisted-pair cables to an RJ45 style jack or plug. One of the most common methods is the use of insulation displacement contacts (IDCs). As the name implies, the connection works by displacing the insulation of the wire being terminated as it is pushed into the contact. Insulation displacement connection is a particularly time-saving connection technology that does not require conductor pretreatment. With this connection method, the cutting metal cuts through the insulation and establishes a reliable connection to the conductor. Typically, this style of IDC is terminated with the use of a tool known as a punch-down tool or impact tool. The impact tool is specifically designed to terminate wires into IDCs by exerting force upon the wire. This force is generated by the action of the user pushing the tool into the wire until an internal spring re-coils within the tool, generating an impact force. Each wire must be guided to the top of the contact, usually through some sort of plastic support mechanism, and then the impact tool is used on all wires individually (usually 8 wires) to create a completed termination.

The above-described method is time consuming for the installer and, therefore, many companies have developed methods to terminate IDC's without the use of an impact tool, which is commonly referred to as a "tool-less" termination. A typical implementation would be to lace all of the conductors within some wire management feature or part, sometimes as a separate element of the whole jack, which would then be terminated using a lever action of some design. Relevant examples are disclosed in U.S. Pat. Nos. 7,540,760 and 9,627,827. These designs terminate all conductors within the same moment, which requires a high degree force and, because of this, the lever action of these designs is required to complete the termination by hand.

With the above-referenced problems taken into consideration, there exists a need in the art for a termination mechanism which reduces the force required to accomplish the termination of all wires wherein the moments in which each wire encounters the respective IDC for termination is staggered.

SUMMARY OF THE INVENTION

In accordance with one form of this invention, there is a provided a termination mechanism for reducing the force required by a user to terminate a plurality of wires by staggering the moment in which each wire of the plurality of wires encounters a respective insulation displacement contact (IDC) when connecting twisted-pair cables to an RJ45 connector, the termination mechanism including a wire manager including a plurality of support members, each of the plurality of support members being sized and configured for securing at least one of the plurality of wires in a corresponding one of a plurality of wire manager slots; a first plurality of the plurality of wire manager slots defining a first grouping of wire manager slots; a second plurality of the plurality of wire manager slots defining a second grouping of wire manager slots; the first and second groupings of wire manager slots being at different depths on the respective ones of the plurality of support members relative to the respective IDCs; and wherein selective force applied by the user to the wire manager in the direction of the PCB causes a first stage of termination wherein each IDC of a first plurality of the IDCs is electrically connected with a corresponding wire of the plurality of wires in the first grouping of wire manager slots and continued selective force applied by the user to the wire manager in the direction of the PCB causes a second stage of termination wherein each IDC of a second plurality of the IDCs is electrically connected with a corresponding wire of the plurality of wires in the second grouping of wire manager slots.

In accordance with another form of this invention, there is provided a termination mechanism for reducing the force required by a user to terminate a plurality of wires by staggering the moment in which each wire of the plurality of wires encounters a respective insulation displacement contact (IDC) when connecting twisted-pair cables to an RJ45 connector, the termination mechanism including a wire manager including a plurality of support members, each of the plurality of support members being sized and configured for securing at least one of the plurality of wires in a corresponding one of a plurality of wire manager slots; a first plurality of the plurality of wire manager slots defining a first grouping of wire manager slots; a second plurality of the plurality of wire manager slots defining a second grouping of wire manager slots, the second grouping of wire manager slots being located interiorly adjacent the first grouping of wire manager slots; the first and second groupings of wire manager slots being at different depths on the respective ones of the plurality of support members relative to the respective IDCs; and wherein selective force applied by the user to the wire manager in the direction of the PCB causes a first stage of termination wherein each IDC of a first plurality of the IDCs is electrically connected with a corresponding wire of the plurality of wires in the first grouping of wire manager slots and continued selective force applied by the user to the wire manager in the direction of the PCB causes a second stage of termination wherein each IDC of a second plurality of the IDCs is electrically connected with a corresponding wire of the plurality of wires in the second grouping of wire manager slots.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION

Referring to the several views of the drawings, the termination mechanism shown and described herein for use as part of a connector 100 and is generally indicated as 10.

Figure 1:
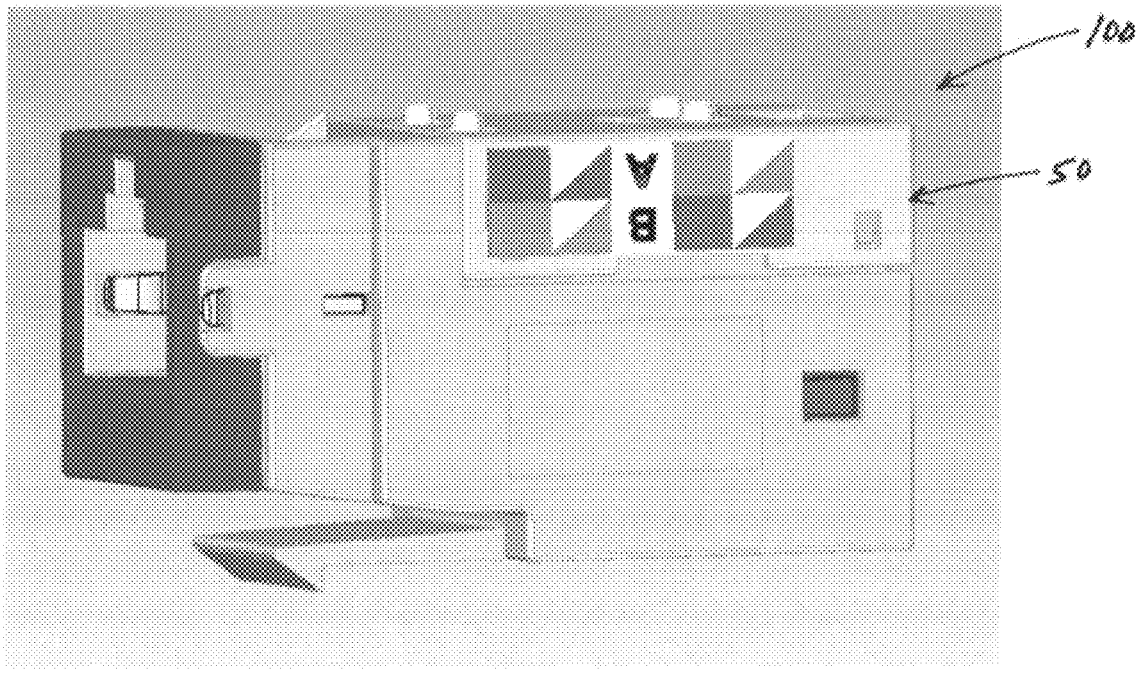
FIG. 1 is a perspective view illustrating a jack.
Figure 2:
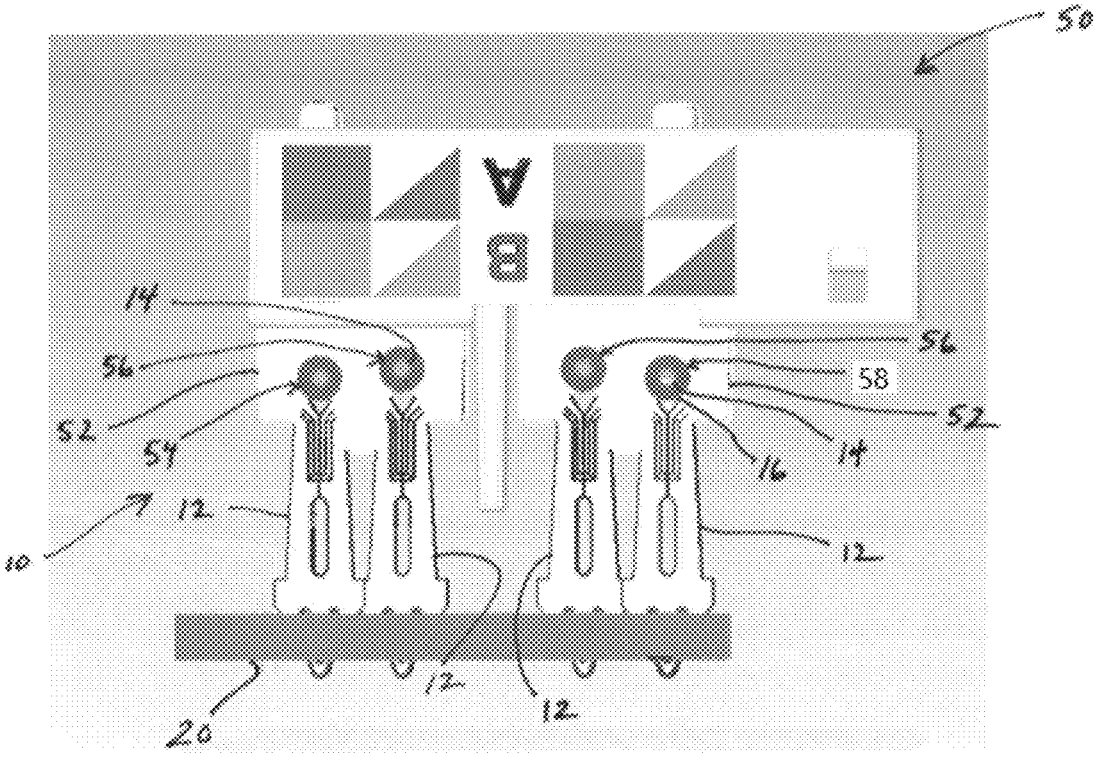
FIG. 2 is an isolated view of the wire manager and PCB with many components having been hidden to better illustrate the process.

Referring initially to FIGS. 1 and 2, in accordance with one embodiment, the connector 100 includes a wire manager 50 and eight insulation displacement contacts (IDCs) 12. Referring specifically to FIG. 2, there are four IDCs 12 located at the outer corners of the termination area (two outer IDCs 12 are visible in top plan view of FIG. 2) and there are four IDCs 12 located interiorly adjacent the four IDCs 12 located at the outer corners. The wire manager 50 includes support members 52 each being sized and configured for securing a plurality of wires 14 each having an insulation layer 16, wherein a first grouping of wire manager slots 54 and a third grouping of wire manager slots 58 are at a first depth on the respective support members 52 and a second grouping wire manager slots 56 at a second depth that is deeper than the first depth on the respective support member 52 relative to the PCB 20.

The IDCs 12 in line with the first and third wire groupings 54 and 58 are the first IDCs 12 to engage the wires 14 and associated insulation layer 16. Generally, as the wire manager 50 moves toward its full seated position, the remaining four wires 14 will be terminated. Still referring to FIG. 2, at the start of pushing the wire manager 50 towards the printed circuit board (PCB) 20, the outer wire insulations 16 (front and back) are just in contact with the respective IDCs 12. The inner wires 14 adjacent to them are not yet making contact with their respective IDCs 12. This view shown in FIG. 2 illustrates only one side, as the other four IDCs 12 and corresponding wires 14 on the opposite side are in the same positions.

Figure 3:
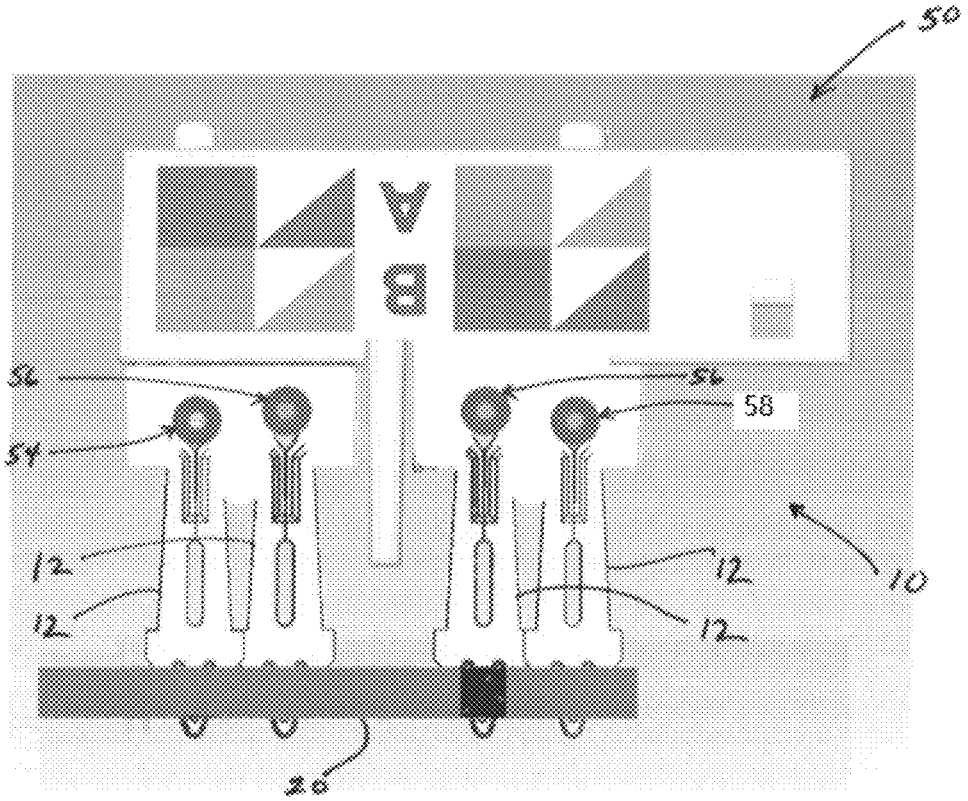
FIG. 3 is an isolated view illustrating movement of the wire manager towards the PCB.
Figure 4:
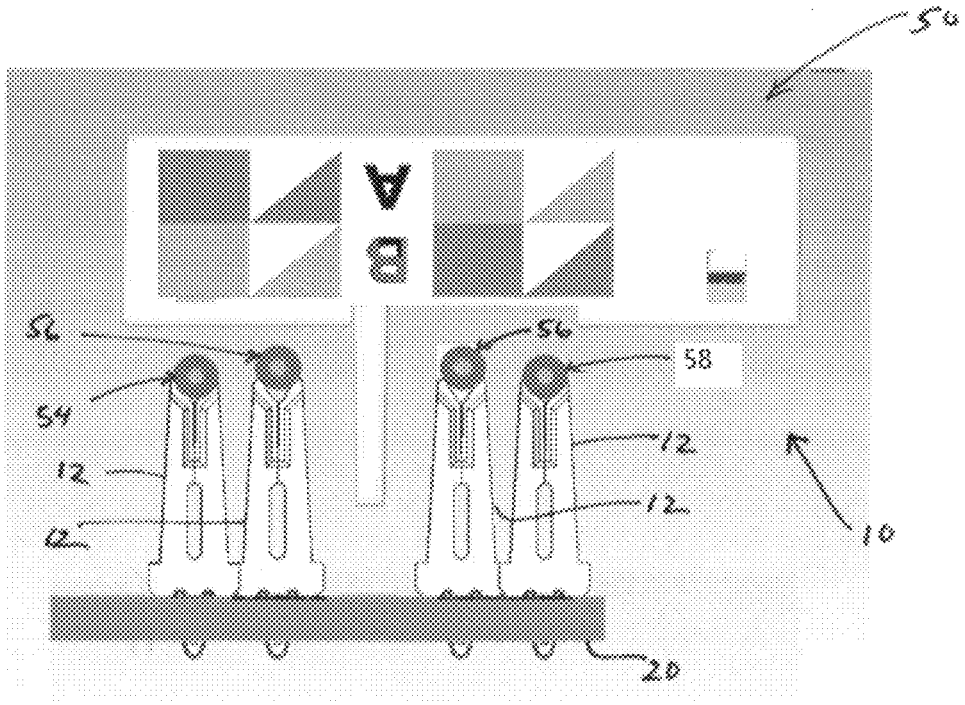
FIG. 4 is an isolated view illustrating movement of the wire manager towards the PCB with many components having been hidden to better illustrate the termination process.

Referring now to FIGS. 3 and 4, as the wire manager moves downward, the outer IDCs 12 begin to displace the insulation 16 of the outer wires 14. The inner wires 14 and respective IDCs 12 are now beginning to come into contact with each other.

Figure 5:
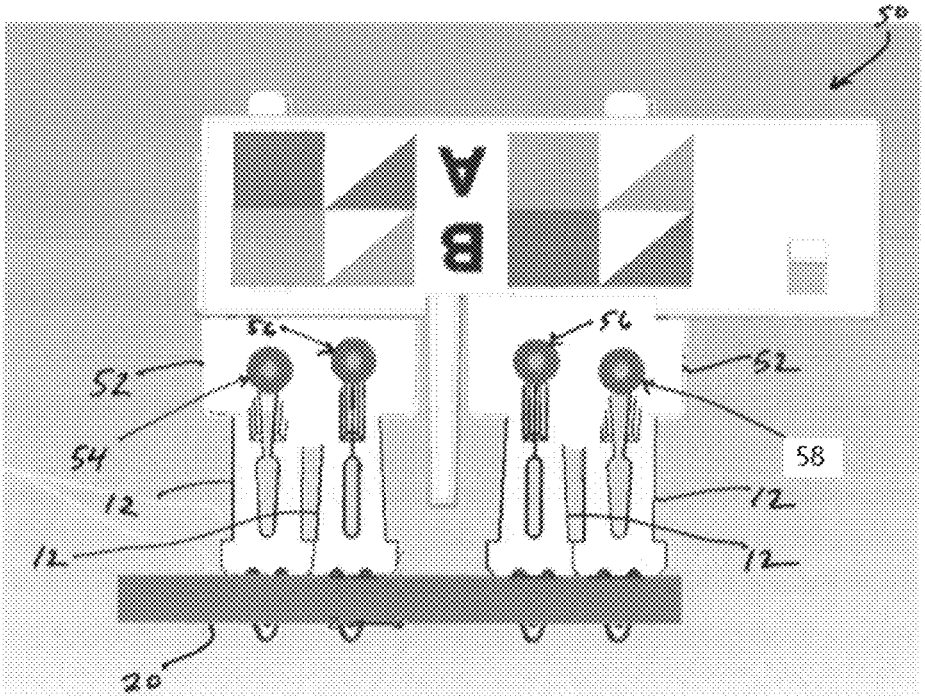
FIG. 5 is an isolated view illustrating movement of the wire manager towards the PCB.
Figure 6:
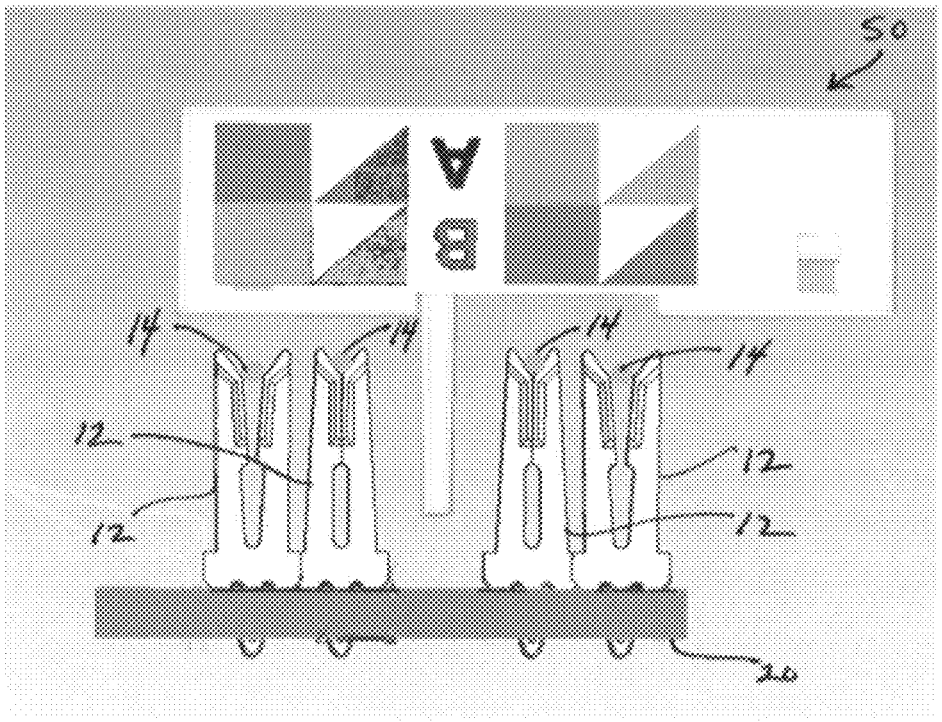
FIG. 6 is an isolated view illustrating movement of the wire manager towards the PCB with many components having been hidden to better illustrate the termination process.

Referring now to FIGS. 5 and 6, as the wire manager 50 continues to travel towards the direction of the PCB 20, the outer wires 14 push the tines of the IDCs 12 apart, due to the copper conductor being inserted into them. This action is the cause of most of the force required to terminate any IDC 12. It is also the action that completes the electrical connection of the wire 14 to the IDC 12, where the outer insulation 16 has been displaced, and the IDC 12 is now in contact with the copper conductor (wire 14) itself. FIG. 5 includes the wire manager in the view while, in FIG. 6, the wire manager 50 and wire insulation 16 has been hidden for clarity. This would be the completion of the first stage of termination, with all four outer wires 14 making contact with the respective IDCs 12, and the inner wires 14 having their respective IDCs 12 in the insulation displacement stage.

Figure 7:
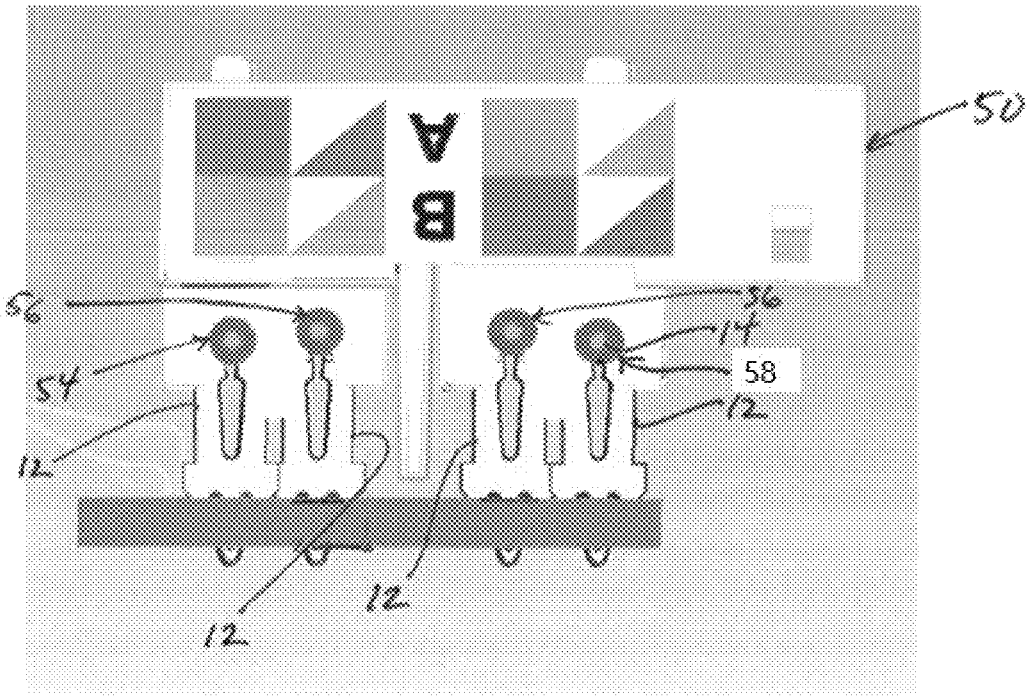
FIG. 7 is an isolated view illustrating the wire manager continuing to be pressed towards the PCB, wherein the second stage of the termination occurs.
Figure 8:
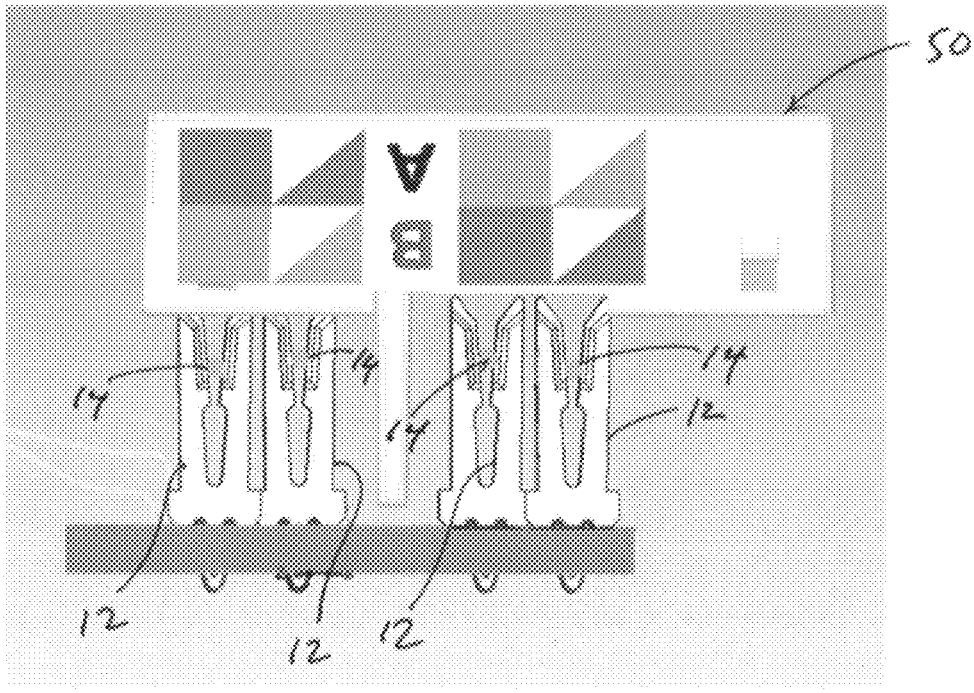
FIG. 8 is an isolated view showing the wire manager in the fully closed position wherein the cable has been completely terminated.

As the wire manager 50 continues to be pressed towards the PCB 20, the second stage of the termination occurs. This results in the inner wires 14 moving further into their respective IDCs 12, spreading apart the tines as the first four did in stage one. At the same time, the outer wires 14 continue to travel further into their respective IDCs 12. FIGS. 7 and 8 illustrate the wire manager 50 in the fully closed position. At this point, the cable has been completely terminated, with all eight wires 14 being electrically connected to all eight IDCs 12.

The two-stage process is achieved by the staggering of the wire manager slots 54 and 56 that hold the individual wire 14. In the embodiment illustrated throughout the drawings, the inner slots 56 are 0.012" deeper (further away from the PCB 20) than the outer slots 54. This depth could be different, but the 0.012" embodiment was chosen because it is about half the diameter of the largest wire the respective jack is designed to accommodate, which is 22 AWG. The method described in the embodiment above uses two steps. The method could be made to utilize up to eight steps, by staggering all eight of the wire manager slots, and utilizing larger IDCs. The outer wires were chosen to be the first to terminate based on the stability of the wire manager. Having the outer four terminate first keeps the wire manager forces evenly distributed to the outer corners on the first step.

From the foregoing description of various embodiments of the invention, it will be apparent that many modifications may be made therein. It is understood that these embodiments of the invention are exemplifications of the invention only and that the invention is not limited thereto.

What is claimed is:

1. A termination mechanism for reducing the force required by a user to terminate a plurality of wires into a respective insulation displacement contact (IDC) when connecting twisted-pair cables to an RJ45 connector, the termination mechanism comprising:

a wire manager including a plurality of support members, each of the plurality of support members being sized and configured for securing at least one of the plurality of wires in a corresponding one of a plurality of wire manager slots;

a first plurality of the plurality of wire manager slots defining a first grouping of wire manager slots and a third grouping of wire manager slots each being at a first depth on the respective ones of the plurality of support members;

a second plurality of the plurality of wire manager slots defining a second grouping of wire manager slots at a second depth that is deeper than the first depth on the respective ones of the plurality of support members;

the second grouping of wire manager slots being located in between the first grouping of wire manager slots and the third grouping of wire manager slots; and wherein selective force applied by the user to the wire manager in the direction of the PCB causes a first stage of termination wherein each IDC of a first plurality of the IDCs is electrically connected with a corresponding wire of the plurality of wires in the first and third groupings of wire manager slots and continued selective force applied by the user to the wire manager in the direction of the PCB causes a second stage of termination wherein each IDC of a second plurality of the IDCs is electrically connected with a corresponding wire of the plurality of wires in the second grouping of wire manager slots.

2. The termination mechanism as recited in claim 1 wherein the first and third groupings of wire manager slots has a depth that is 0.012 inches deeper than the depth of the second grouping of wire manager slots.

3. The termination mechanism as recited in claim 1 wherein the first and third groupings of wire manager slots comprises four wire manager slots.

4. The termination mechanism as recited in claim 1 wherein the second grouping of wire manager slots comprises four wire manager slots.

5. A termination mechanism for reducing the force required by a user to terminate a plurality of wires into a respective insulation displacement contact (IDC) when connecting twisted-pair cables to an RJ45 connector, the termination mechanism comprising:

a plurality of support members, each of the plurality of support members being sized and configured for securing at least one of the plurality of wires in a corresponding one of a plurality of wire manager slots;

a first plurality of the plurality of wire manager slots defining a first grouping of wire manager slots and a third grouping of wire manager slots each being at a first depth on the respective ones of the plurality of support members;

a second plurality of the plurality of wire manager slots defining a second grouping of wire manager slots at a second depth that is deeper than the first depth on the respective ones of the plurality of support members;

the second grouping of wire manager slots being located in between the first grouping of wire manager slots and the third grouping of wire manager slots; and wherein selective force applied by the user to the plurality of support members in the direction of the PCB causes a first stage of termination wherein each IDC of a first plurality of the IDCs is electrically connected with a corresponding wire of the plurality of wires in the first and third groupings of wire manager slots and continued selective force applied by the user to the plurality of support members in the direction of the PCB causes a second stage of termination wherein each IDC of a second plurality of the IDCs is electrically connected with a corresponding wire of the plurality of wires in the second grouping of wire manager slots.

6. The termination mechanism as recited in claim 5 wherein the first and third groupings of wire manager slots has a depth that is 0.012 inches deeper than the depth of the second grouping of wire manager slots.

7. The termination mechanism as recited in claim 5 wherein the first and third groupings of wire manager slots comprises four wire manager slots.

8. The termination mechanism as recited in claim 5 wherein the second grouping of wire manager slots comprises four wire manager slots.

* * * * *